US007385460B1

(12) United States Patent
Wang et al.

(10) Patent No.: US 7,385,460 B1
(45) Date of Patent: Jun. 10, 2008

(54) COMBINED ELECTROSTATIC AND OPTICAL WAVEGUIDE BASED MICROFLUIDIC CHIP SYSTEMS AND METHODS

(75) Inventors: Fei Wang, Pasadena, CA (US); David Erickson, Ithaca, NY (US); Changhuei Yang, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 134 days.

(21) Appl. No.: 11/264,980

(22) Filed: Nov. 1, 2005

Related U.S. Application Data

(60) Provisional application No. 60/628,724, filed on Nov. 17, 2004.

(51) Int. Cl.
*H01P 5/00* (2006.01)

(52) U.S. Cl. ..... 333/108; 333/208

(58) Field of Classification Search ..... 333/108, 333/113, 114, 122, 208, 248; 250/281, 440.11, 250/442.11
See application file for complete search history.

(56) References Cited

U.S. PATENT DOCUMENTS

| | | | |
|---|---|---|---|
| 6,611,339 | B1 | 8/2003 | Yang et al. |
| 6,847,456 | B2 | 1/2005 | Yang et al. |
| 6,934,035 | B2 | 8/2005 | Yang et al. |
| 7,019,838 | B2 | 3/2006 | Izatt et al. |
| 7,068,874 | B2 * | 6/2006 | Wang et al. ..... 385/16 |
| 7,075,658 | B2 | 7/2006 | Izatt et al. |
| 7,261,687 | B2 | 8/2007 | Yang |
| 2002/0101593 | A1 | 8/2002 | Yang et al. |
| 2003/0112444 | A1 | 6/2003 | Yang et al. |
| 2004/0239943 | A1 | 12/2004 | Izatt et al. |
| 2005/0036150 | A1 | 2/2005 | Izatt et al. |
| 2005/0057756 | A1 | 3/2005 | Fang-Yen et al. |
| 2005/0105097 | A1 | 5/2005 | Fang-Yen et al. |
| 2005/0234345 | A1 | 10/2005 | Yang |
| 2005/0258375 | A1 | 11/2005 | Mertz et al. |
| 2005/0271548 | A1 | 12/2005 | Yang et al. |
| 2006/0061769 | A1 | 3/2006 | Yang et al. |
| 2007/0066871 | A1 | 3/2007 | Yang et al. |
| 2007/0207061 | A1 | 9/2007 | Yang et al. |

OTHER PUBLICATIONS

Fu, Anne Y. et al.; "A microfabricated fluorescence-activated cell sorter"; 1999, *Nature Biotechnology*, vol. 17, 1109-1111.
Kumar P. Suresh et al.; "A fibre optic evanescent wave sensor used for the detection of trace nitrites in water"; 2002, *Journal of Optics A*, vol. 4, pp. 247-250.

(Continued)

*Primary Examiner*—Dean Takaoka
(74) *Attorney, Agent, or Firm*—Townsend and Townsend and Crew LLP

(57) ABSTRACT

A system for detecting interactions between charged targets and analytes. The system includes a fluid channel, and a waveguide associated with the fluid channel. A detection region is associated with the waveguide, and a biasing element is operatively coupled to the detection region. The biasing element is adapted to electrically bias a portion of the waveguide at the detection region, and the charged targets are electrostatically bound to the detection region when the portion of the waveguide is electrically biased. An optical detector is adapted to detect optical changes from the detection region.

18 Claims, 4 Drawing Sheets

OTHER PUBLICATIONS

Quinten, M. et al.; "Scattering and extinction of evanescent waves by small particles"; 1999, *Applied Physics B*, vol. 68, pp. 87-92.

Stone, H.A. et al.; "Engineering Flows in Small Devices: Microfluidics Toward a Lab-on-a-Chip"; 2004, *Annu. Rev. Fluid Mech.*, vol. 36, pp. 381-411.

Tai, Yu-Chong et al.; "Integrated Micro/Nano Fluidics for Mass-spectrometry Protein Analysis"; 2002, *International Journal of Nonlinear Sciences and Numerical Simulation*, vol. 3, pp. 739-741.

Xie, Jun et al.; "An Electrochemical Pumping System for On-Chip Gradient Generation"; 2004, *Anal. Chem.*, vol. 76, pp. 3756-3763.

Fu, A. Y., H.P. Chou, et al., "An Integrated Microfabricated Cell Sorter," *Analytical Chemistry* (2002), vol. 74, No. 11:2451-2457.

Jensen, J.B., L.H. Pedersen, et al. "Photonic Crystal Fiber Based Evanescent-Wave Sensor for Detection of Biomolecules in Aqueous Solutions," *Optics Letters* (2004), vol. 29, No. 17:1974-1976.

* cited by examiner

COMBINED ELECTROSTATIC AND OPTICAL WAVEGUIDE BASED MICROFLUIDIC CHIP SYSTEMS AND METHODS

CROSS-REFERENCES TO RELATED APPLICATIONS

This application is a non-provisional of and claims the benefit of the filing date of U.S. Provisional Application No. 60/628,724, entitled "Combined Electrostatic and Optical Waveguide Based Microfluidic Chip Systems for Bio-Molecule and Bio-Entity Detection and Processing", filed on Nov. 17, 2004, which is herein incorporated by reference in its entirety for all purposes.

STATEMENT AS TO RIGHTS TO INVENTIONS MADE UNDER FEDERALLY SPONSORED RESEARCH OR DEVELOPMENT

Not Applicable

BACKGROUND OF THE INVENTION

Roughly 42 million people around the world are infected with HIV (AIDS). In 2003 alone, there were five million cases of HIV infection and three million people died from AIDS. One fourth of the patients were unaware they had the virus and could unknowingly pass the virus onto others. Currently, there is no cure for AIDS.

A number of laboratory methods are available to screen blood, diagnose infection, and monitor disease progression in individuals infected by HIV. These tests can be classified into those that (a) detect antibodies, (b) identify antigens, (c) detect or monitor viral nucleic acids, and (d) provide estimates of T-lymphocyte numbers (cell phenotyping).

Of these methods, antibody detection is the most widely used and most effective in identifying HIV infection. Such tests include Enzyme-Linked Immuno-Sorbent Assays (ELISA), Western Blots, and Indirect Fluorescent Antibody (IFA) tests.

ELISA stands for "enzyme-linked immunosorbent assay". This screening test is usually the first test that is used to detect infection with HIV. One common feature to all varieties of ELISA is the use of enzyme conjugates that bind to specific HIV antibodies, and substrates/chromogens that produce color in a reaction catalyzed by the bound enzyme conjugate.

A Western blot test, which is harder to perform and interpret than an ELISA test, is usually done to confirm the results of two positive ELISA tests. A typical Western blotting technique consists of the following parts: (1) separation of polypeptides by SDS-PAGE; (2) electro-transfer of separated proteins from the gel onto the blotting paper; (3) labeling of the transferred proteins by antibodies conjugated with the enzyme; and (4) detection of the labeling enzyme signal.

Indirect Fluorescent Antibody (IFA) tests can be used to detect antibodies that are made to fight an HIV infection. Like a Western blot test, it is used to confirm the results of ELISA tests. IFA tests are more expensive than Western blot tests.

While the above-described antibody tests are effective, HIV antibodies generally do not reach detectable levels until 1-3 months following infection. For example, it sometimes takes up to 6 months for antibodies to be generated in large enough quantities to show up in standard blood tests.

Another type of test is P24 antigen testing. P24 antigen is a protein that is part of the HIV virus. Early in the infection process, P24 antigen is produced in excess (each particle of the virus contains about 3,000 molecules of the p24 protein) and can be detected in the blood serum by a commercially available test. The P24 test can detect HIV infection before the body develops enough detectable viral antibodies.

Yet another type of test is a Plasma Viral Load (PVL) test. There are several different plasma viral load tests. Two are currently approved for general use. The first one is called the Amplicor HIV-1 Monitor test, better known as the PCR test. The other is called NucliSens HIV-1 QT or NASBA. These tests were approved by the FDA to check the health of people with HIV. The Plasma Viral Load test measures the quantity of RNA of the HIV virus in human plasma.

For people who are already diagnosed with AIDS, a T-lymphocyte (also called CD4+, a type of white blood cell) count measurement can be performed regularly to monitor how the HIV virus affects the immune system. (It is well known that HIV infects CD4+ cells.) Most people infected with HIV who are not being treated experience a gradual drop in the number of CD4+ cells over time. The number of CD4+ cells indicates the health of the immune system and the likelihood that opportunistic infections may occur.

The above tests are useful, but are fairly time- and sample-consuming. For instance, ELISA results are usually available in two to four days. Results of other tests, such as the Western blot or IFA, take as long as one to two weeks.

It would be desirable to provide for a improved tests and testing methods. Embodiments of the invention address these and other problems.

SUMMARY OF THE INVENTION

Embodiments of the invention are directed to systems and methods for detecting interactions between targets and analytes. Embodiments of the invention can also be used to sort entities such as targets and analytes, or target-analyte pairs. Characteristics and/or properties of targets and analytes can also be determined using embodiments of the invention.

One embodiment of the invention is directed to a system. The system includes: a fluid channel; a waveguide associated with the fluid channel; a detection region associated with the waveguide; a biasing element operatively coupled to the detection region, wherein the biasing element is adapted to electrically bias a portion of the waveguide at the detection region; and an optical detector adapted to detect optical changes from the detection region.

Another embodiment of the invention is directed to a method. The method includes: electrically biasing a portion of a waveguide at a detection region, wherein the waveguide is associated with a fluid channel; localizing targets at the detection region; supplying a fluid to the detection region wherein the fluid comprises analytes; and detecting whether or not analytes interact with the localized charged targets.

Other embodiments of the invention are directed to systems including bioentities sorters and the like.

These and other embodiments of the invention are described in further detail below.

DETAILED DESCRIPTION

Figure 1A:
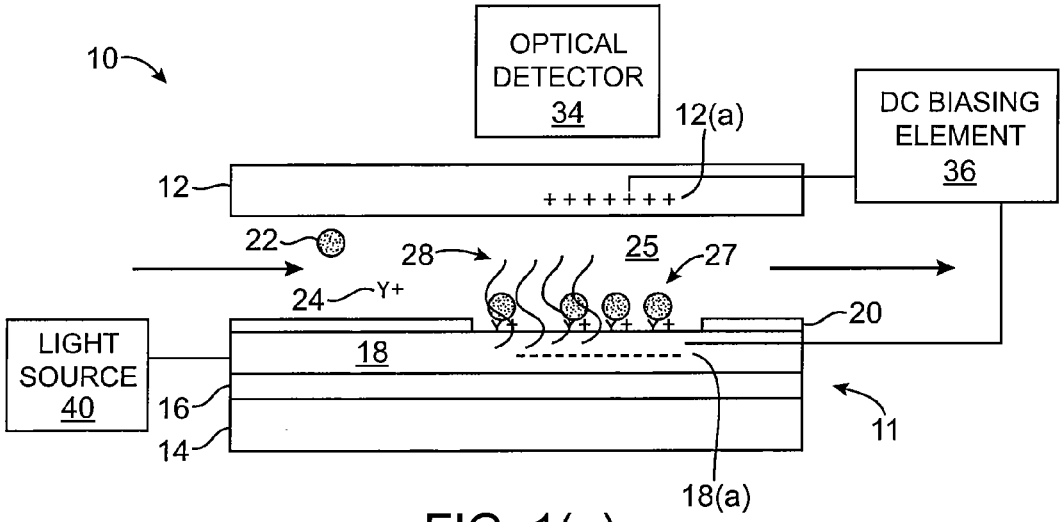
FIGS. 1(*a*) and 1(*b*) show side cross-sectional schematic views of system according to an embodiment of the invention using DC and AC biasing elements, respectively. Planar waveguides may be employed in both cases.

One embodiment of the invention is directed to a system for detecting interactions between charged targets and analytes. In embodiments of the invention, the targets and analytes may be chemical or biological entities that may be may not be capable of interacting (e.g., binding, reacting, etc.) with each other.

The "targets" according to embodiments of the invention are preferably localizable at a detection region of the system using electrostatic forces. For example, the targets may be positively or negatively charged so that they may be electrostatically bound and/or manipulated at the detection region in the system. The targets may already be inherently charged, or they may be intentionally charged (e.g., by incorporating appropriate ions in the targets). After the targets are localized, any potential interactions between the targets and the analytes can be observed at the detection region.

The "analytes" according to embodiments of the invention are typically entities that are tested for interactions with targets. The analytes, as well as the targets, may be present in a liquid medium when they are initially introduced to the system. Exemplary liquid media may include naturally occurring biological fluids such as blood, urine, etc., or may include pre-prepared liquid media including saline solutions, etc.

Exemplary targets and analytes can encompass a wide variety of molecules ranging from small molecules to large proteins and polynucleotides, as well as a variety of interaction pairs. Examples of potential interaction pairs include (representative interaction partners are parenthetically identified): antigen (specific antibody), antibody (antigen), hormone (hormone receptor), hormone receptor (hormone), polynucleotide (complementary polynucleotide), avidin or streptavidin (biotin), biotin (avidin or streptavidin), enzyme (enzyme substrate or inhibitor), enzyme substrate or inhibitor (enzyme), lectins (specific carboxyhydrate), specific carboxyhydrate (lectins), lipids (lipid binding proteins or membrane associated proteins), lipid binding proteins or membrane associated proteins (lipids), polynucleotides (polynucleotide binding proteins), polynucleotide binding proteins (polynucleotides), receptor (transmitter), transmitter (receptor), drug (target), target (drug), as well as more general types of interactions such as protein (protein), protein (polynucleotide), polynucleotide (protein), small molecule (protein), protein (small molecule), enzyme (small molecule), receptor (small molecule), polypeptide (small molecule), polynucleic acid (small molecule), DNA (DNA), DNA (RNA), RNA (DNA) interactions, and the like.

Any of the bioentities mentioned above may be targets or analytes in embodiments of the invention. In addition, exemplary targets and/or analytes could also include microorganisms such as bacteria or viruses, or non-biological entities such as inorganic particles or molecules. Thus, although biodetection is described in detail in this application, it is understood that embodiments of the invention encompass systems and methods that can be used, for example, for chemical analysis or detection.

The identities of the targets and/or the analytes may or may not be known before they are introduced to each other to see if they interact with each other. For example, the targets may be charged protein receptors which are bound at a detection region in the system. Analytes can be potential drug candidates that are known. They can be tested for their ability to bind to the protein receptors. In other embodiments, the analytes may be unknown components in a blood sample and those components may be introduced to localized targets to see if they interact with them.

The system also includes at least one fluid channel, and at least one waveguide associated with the at least one fluid channel. In some embodiments, the at least one fluid channel may include a microfluidic fluid channel. In general, microfluidic channels have very small dimensions. For example, a typical microfluidic channel can have a dimension (e.g., height or width) that is less than about 1 mm in some embodiments. A waveguide can form at least part of the structure forming the microfluidic fluid channel. For example, as illustrated below, the waveguide may form part of a bottom wall of the fluid channel in some embodiments.

Potential interactions between targets and analytes can be observed and/or detected at the detection region in the system. At the detection region, charged targets may be localized using an electrically conductive and electrically biased material. A biasing element can be operatively coupled to the detection region to electrically bias a portion of the structure forming the fluid channel.

In embodiments of the invention, the biasing element may be a DC voltage source or an AC voltage source. If a DC voltage source is used, the charged targets may be electrostatically bound to the detection region when the portion of the waveguide is electrically biased. For example, the targets may be antibodies that are positively charged and these positively charged antibodies may be electostatically bound to a negatively charged portion of the waveguide. If an AC voltage source is used, the charged targets may oscillate at the detection region and may be confined to the detection region.

In both cases, charged targets are isolated at the detection region so that possible target/analyte interactions at the detection region can be observed. For instance, in the detection region, potential binding interactions between targets (e.g., biological targets) and analytes (e.g., biological analytes) can be detected. Potential interactions can be observed by observing changes in the properties of evanescent waves coming from the waveguide at the detection region. For example, when analytes bind to targets that are localized in the detection region, the properties of the evanescent waves coming from the detection region are different than the properties of evanescent waves that are produced when analytes are not bound to localized targets. The differences in evanescent wave properties can be used to determine if there is any interaction between analytes in a fluid sample and localized targets.

In embodiments of the invention, an optical detector can be used to detect optical changes (e.g., changes in evanescent wave properties) from the detection region. An example of a suitable optical detector is a photomultiplier tube. Such optical detectors are commercially available and need not be described in detail.

As noted above, the methods and systems according to embodiments of the invention are preferably used in conjunction with microfluidic systems. The use of microfluidics for cell sorting, flow cytometry (Fu, A. et al., *Nature Biotechnology* 17(11):1109-1111 (1999); Fu, A. Y. et al., *Analytical Chemistry* 74(11):2451-2457 (2002)) and chromatography (Xie, J. et al., *Analytical Chemistry* 76(13): 3756-3763 (2004) and Tai, Y. et al., *International Journal of Nonlinear Sciences and Numerical Simulation* 3(3-4):739-741 (2002)) has been demonstrated and reported in recent years. The advantages associated with such lab-on-a-chip microfluidic devices are numerous. For example, lab-on-a-chip devices require far lower test sample volumes than conventional testing devices such as test tubes, are compact, inexpensive to produce, and can be scaled up so that parallel analyses can be performed.

Embodiments of the invention can improve upon the capabilities of conventional microfluidic systems. As will be described in further detail below, changes in evanescent waves can be detected when targets and analytes interact with each other. These evanescent wave changes can be used to determine whether analytes such as viruses (e.g., HIV viruses) are present in a sample fluid.

I. EVANESCENT WAVE BASED SENSING

Evanescent waves are electromagnetic fields that extend beyond the core of a waveguide and decay exponentially with distance from the core surface. There are numerous sensor designs that are based on evanescent wave detection. These sensor designs operate under the assumption that the evanescent fields of guided light modes are highly sensitive to perturbations caused by phenomena of interest. These perturbations can be changes in the refractive index of a waveguide cladding, the proximity of fluorophores (such as quantum dots and nanoparticles), the presence of light scatterers, etc.

Because evanescent waves decay exponentially, perturbations in the immediate region outside of a waveguide core can be detected without difficulty. A number of techniques can allow an evanescent field to penetrate a medium to be tested. For instance, part of the optical cladding of a waveguide can be removed to expose the core of the waveguide. The core is exposed so that the evanescent field produced by light in the core is exposed to the medium of interest (e.g., a biological liquid sample). If the medium of interest is a biological liquid, the biological liquid can form a cladding for the exposed core. The evanescent wave that extends from the exposed portion of the core is very sensitive to changes in the refractive index of the liquid cladding. Such changes can be caused by, for example, chemical or immuno-reactions. In such devices, a short unclad portion of a fiber can be immersed in a fluid containing the analyte of interest and the region including the exposed fiber core can form at least part of a detection region. The optical transmission of light from the fiber at the detection region can be measured to reflect the concentration variations of the analyte (Kumar, P. S. et al., *Journal of Optics a-Pure and Applied Optics* 4(3):247-250 (2002)).

The same evanescent field penetration can also be achieved by bending an optical fiber or by using a fiber thinned by fusion and pulling. Alternatively, without pulling or stripping the fiber, the air-holes of a photonic crystal fiber (Jensen, J. B. et al., *Optics Letters* 29(17): 1974-1976 (2004)) can allow a liquid sample to access regions of the optical fiber where strong evanescent fields exist. Embodiments using photonic crystal fibers are discussed in detail below.

II. ELECTROSTATIC AND EVANESCENT WAVE BASED SYSTEMS

In its most basic implementation, a system according to an embodiment of the invention includes a waveguide embedded under a microfluidic channel. The waveguide can be designed so that an evanescent field can be transmitted into the microfluidic channel and subsequently detected. The waveguide itself or a region near the waveguide can be appropriately treated so that it is electrically conductive, yet remains optically transmissive (such as by coating on a layer of indium tin oxide (ITO)).

Figure 1B:
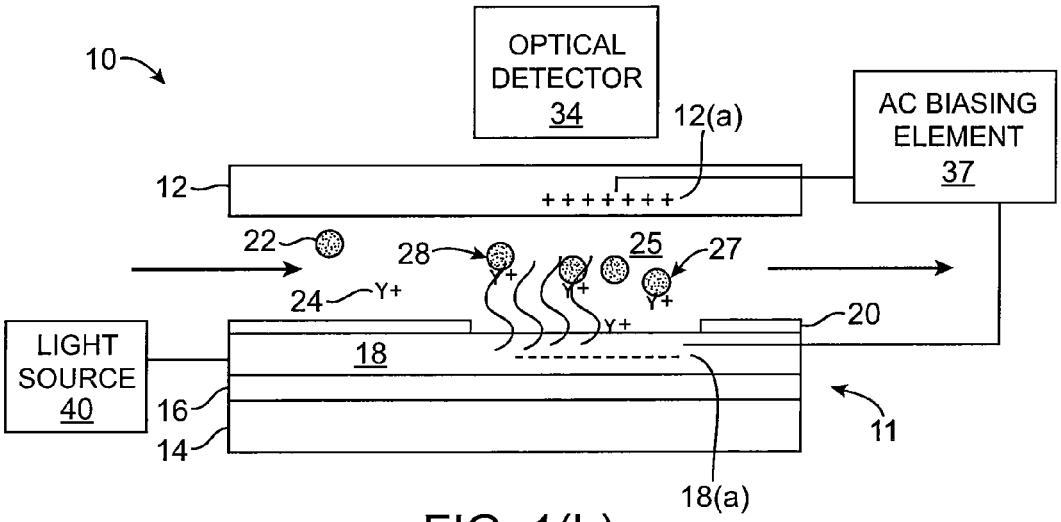

FIG. 1(*a*) shows a system 10 according to an embodiment of the invention. The system 10 includes a substrate 14. The substrate 14 may be formed from a material (e.g., a semiconductor material) such as silicon or any other suitable material. As shown in FIG. 1(*a*), a planar waveguide 11 is on the substrate 14. The waveguide 11 comprises a core 18 and upper and lower cladding layers 16, 20 around the core 18. The core 18 has a higher index of refraction than the cladding layers 16.

The system 10 also includes a detection region 27. At the detection region 27, potential interactions between charged targets 24 and analytes 22 can be detected. As will be explained in further detail below, in the detection region 27, changes in evanescent light waves 28 caused by interacting targets 24 and analytes 22 can be detected by an optical detector 34.

At the detection region 27 shown in FIG. 1(*a*) the upper cladding layer 20 is discontinuous, and the core 18 is exposed. Since there is no upper cladding layer at the detection region 27, a liquid medium 25 between the waveguide 11 and an upper cover layer 12 can serve as a "cladding" for the core 18 at the detection region 27. The liquid medium 25 may flow in the direction shown by the illustrated arrows and may have a lower index of refraction than the core 18. The area around the interface of the liquid "cladding" and the core 18 at the detection region 27 is particularly sensitive to changes in evanescent light.

At the detection region 27, a portion 12(*a*) of the upper cover layer 12 can also be made electrically conductive. For example, the portion 12(*a*) of the upper cover layer 12 can be made of plastic or an inorganic material and may be doped with an electrically conductive material at the portion 12(*a*). The core 18 of the waveguide 11 may also have a core portion 18(*a*) that is doped with an electrically conductive material. Doping processes are known to those of ordinary skill in the art. As an alternative to doping, electrical contacts can be formed on the portion 12(*a*) of the upper cover layer 12 and at the core portion 18(*a*) of the core 18. The electrical contacts may be formed from a transparent conductive material such as ITO (indium tin oxide). In both cases, the detection region may have a pair of discrete electrically conductive and oppositely charged portions associated with it.

A DC biasing element 36 can be used to electrically bias the core 18 of the waveguide 11 and also the upper cover layer 12. An exemplary DC biasing element may be a battery. As noted above, the core portion 18(*a*) and the portion 12(*a*) of the cover layer 12 may be electrically conductive. These electrically conductive portions 12(*a*), 18(*a*) can be electrically coupled to the biasing element 36.

If the biasing element 36 is a DC biasing element as shown in FIG. 1(*a*), the DC biasing element 36 can be used to electrically bias the electrically conductive portions 12(*a*), 18(*a*) so that charged targets 24 are electrostatically bound to the biased core portion 18(*a*) and are electrostatically repelled by the biased portion 12(*a*) of the core layer 12.

As shown in FIG. 1(*a*), the core portion 18(*a*) can be biased with negative charges and they can attract the positively charged targets 24. The positively charged targets 24 may be introduced to the detection region using a suitable liquid medium, and they are thereafter localized at the detection region 27. After the charged targets 24 are localized at the detection region 27, the analytes 22 of interest may then be introduced to the detection region 27 to see if they interact with (e.g., bind to) the localized charged targets 24. For example, if the analytes 22 bind to the localized charged targets 24, they may clump together thereby scattering the evanescent waves 28. The evanescent wave scattering produces a change in the optical signal produced at the detection region 27. The optical signal change can consequently indicate whether or not binding (or other interaction) between the localized charged targets 24 and the analytes 22 has occurred. If the analytes 22 do not bind to the localized charged targets 24, then there may be little or no change in the optical signal produced at the detection region 27.

Illustratively, blood plasma and charged antibodies specific to the analyte of interest can be injected into a microfluidic channel and allowed to mix upstream of a detection region. After mixing, a static voltage is applied to the portions defining the fluid channel (as described above). One portion forming the fluid channel will attract the charged antibodies. Biomolecules which do not specifically bind to the bound and localized charged antibodies will pass downstream of the detection region. If bioentities (e.g., viruses) specifically bind to the bound and charged antibodies, the evanescent wave around the waveguide at the bottom of the fluid channel will be scattered to a greater extent than if the bioentities were not attached to the antibodies. This increased scattering can form a positive test and can indicate the presence of the analyte bioentites and/or relative concentration of the analyte bioentitles. In the case of a negative test, the unconjugated, charged and localized antibodies will still be attracted to the walls of the fluid channel at the detection region. However, other bioentites (e.g., larger viruses) will not be attached to the localized antibodies (e.g., an antibody has sub-nanometer dimensions, while a virus has dimensions on the order of tens of nanometer). Little or no scattering of evanescent waves would be observed in this case.

In other embodiments, an AC biasing element 37 may be used instead of a DC biasing element 36. An AC biasing element 37 is shown in FIG. 1(*b*). The other features of FIG. 1(*b*) are the same as the features in FIG. 1(*a*) and like numerals designate like elements in FIGS. 1(*a*) and 1(*b*).

In embodiments of the invention, one can apply an AC voltage to portions defining the fluid channel so that the charged targets will oscillate transversely across the fluid channel. Large analytes may bind to the oscillating targets to produce large, oscillating scattering entities. Because of the motion of the large scattering entities, the amount of scattered evanescent field will also oscillate correspondingly. Since the motions of the scattering entities will depend on their sizes and charges, it is possible to measure the amplitude and phase of the scattering evanescent signal (relative to the AC voltage applied to the waveguide) to obtain information about the size and/or mass of the analytes of interest.

Referring again to FIG. 1(*b*), the AC biasing element 37 applies an AC voltage between the core 18 of the waveguide 11 and the upper cover layer 12 of the fluid channel. As a result, the charged targets 24 in the fluid channel 25 can undergo forced damped oscillations in a transverse direction (perpendicular to the longitudinal direction of the fluid channel 25) in the presence of the produced AC electric field. The oscillating motions produced by the charged targets 24 will cause the amount of scattered evanescent waves to oscillate as a function of the applied AC field, the viscosity of the fluid in the fluid channel 25, and the targets' sizes and mass-to-charge ratios.

In some embodiments, the charged targets 24 may be antibodies or antigens. Since the individual antigens or antibodies are much smaller than the characteristic decay lengths of the evanescent waves 28 (about 1 micron), and only bound target 24 and analyte 22 pairs have the appropriate sizes comparable to characteristic decay lengths, it is possible to attribute variations in detected and scattered evanescent waves to the oscillation of the bound interaction pairs. The bound interaction pairs' presence and properties, such as size and mass-to-charge ratio, can also be determined by evaluating the characteristics of the scattered light. Thus, embodiments of the invention can be used to determine if there are any interactions between targets and analytes of interest. They can also be used to analyze the characteristics (e.g., mass-to-charge ratios) of the targets and/or analytes.

It is apparent that the interaction between the targets and analytes can lead to increased scattering of evanescent wave signals. In preferred embodiments, analytes may include bioentites such as proteins, cell derivatives, viruses, cells, bacteria, etc. Charged targets may include antibodies that can interact with the previously mentioned bioentities. Other examples of suitable bioentites are provided above.

As noted above, when antibodies bind directly to bioentities such as viruses, bacteria, and cells of interest (such as the HIV virus itself), the bioentities can function as effective scatterers. Under specific conditions, the binding may also result in multiple bioentities aggregating together to form clumps. These clumps may also function as efficient scatterers. For example, when testing for the presence of specific free floating antigens, such as the P24 antigen in the case of HIV virus detection, the interaction between the antibodies and antigens can result in their aggregation. This aggregation or "clumping" effect can increase the amount of scattered evanescent light.

In embodiments of the invention, the detection of the scattered light signals can be achieved by at least three different approaches. First, it is possible to directly detect scattered light caused by analyte/target interactions. This is shown in FIGS. 1(*a*) and 1(*b*). Since the evanescent light field is a non propagating field, the direct observation of scattered light from the detection region of the system can be a direct and linear measure of the concentration or presence of the bioentities of interest. Second, it is possible to measure the power output change or phase shift of the light that is transmitted through the waveguide. This method is the simplest to implement. For example, it is possible to have an optical detector located at the end of the waveguide 11 in FIG. 1(*a*) to detect changes in the propagating light wave. Third, it is possible to measure the transmitted power that is reflected back through the waveguide. The presence of evanescent wave scattering entities can lead to a perturbation in the transmission that creates a back reflection component. The detection of this component can function as an indirect measure of the concentration of analyte bioentities in the detection region.

These three detection processes can be performed while manipulating the voltage at portions of the system to change the electrical bias at those portions. The changing bias controls the trapping and releasing of appropriately charged target bioentities. For instance, after some time, the charged particles that are localized at the charged detection region can reach a saturation level, due to repulsion from similarly charged particles that are already localized at the detection region. In this case, the voltage applied to the waveguide can be reversed for a short duration to "flush" the detection region. After the detection region is flushed of charged targets, the detection region can be appropriately re-charged by re-reversing the voltage at the detection region so that new targets can accumulate at the detection region.

There are many possible specific system configurations that can be used. The systems according to embodiments of the invention can be made by those of ordinary skill in the art. They may use fabrication techniques that are well known in the semiconductor and microfludics industries.

Illustratively, one may use an integrated flat panel waveguide in a PMMA (polymethylmethacrylate)-microfluidic channel. In this configuration, a flat panel waveguide is first fabricated on a silicon wafer. The flat panel waveguide may include a silicon dioxide core and at least upper and lower cladding layers that have lower indexes of refraction than the core. The formation of such layers is well known to those of ordinary skill in the art (e.g., chemical vapor deposition, thermal oxidation lamination, etc.). The cladding of a section of the waveguide can be chemically removed (e.g., by etching, milling, laser ablation, etc.), so that the silicon dioxide core is exposed. The exposed core can then be doped or coated with indium tin oxide (ITO), or some other conductive material, so that it is conductive and can thus be positively charged when connected to an electrode.

In other embodiments, a core may be doped first or coated with a transparent, electrically conductive material. After rendering a portion of the core conductive, a discontinuous cladding layer may be formed on the core. For example, a photoresist mask may be formed on the core and exposed portions of the core may be filled with cladding material. The photoresist layer may then be stripped leaving a discontinuous cladding layer on the core.

After the waveguide is formed, optical fibers are then coupled to both the inlet and outlet of the waveguide in order to couple light into and out of the waveguide. A light source (e.g., a laser) may be coupled to the inlet optical fiber to supply light to the waveguide. A three-sided structure is placed on top of the waveguide to form a sealed microfluidic channel. Fluid flow in the micro-fluidic channel can then be induced within the channel by using a pressure driven transport or electrokinetic mechanism. Such mechanisms are well known to those of ordinary skill in the art.

Alternatively, instead of a flat panel or planar waveguide, it is possible to use an optical fiber waveguide in the microfluidic channel. This scheme is the same as the previously described one, except that an optical fiber waveguide is embedded at the bottom of a microfluidic channel. A section of the plastic cladding is chemically removed (e.g., using an etchant) and is doped and/or coated with a conductive material. The advantage of using an optical fiber over an integrated flat panel waveguide is that guided modes are well behaved in the fiber. It is also easier to couple light into and out of an optical fiber waveguide than a flat or planar waveguide.

Other waveguide configurations may be used in other embodiments of the invention.

II. SORTER SYSTEMS

In addition to detecting interactions between biological and/or chemical entities, embodiments of the invention can also be used as electrokinetic microfluidic bio- or chemical entity sorters.

Figure 2:
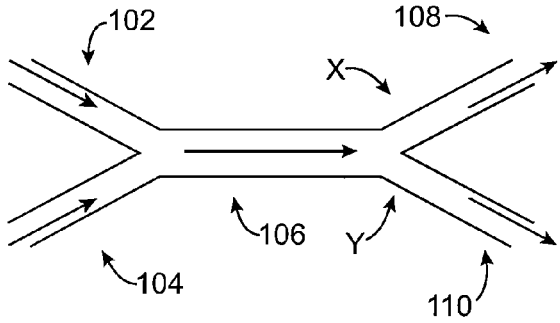
FIG. 2 shows a schematic view of another system including a sorter.

A first sorter design can be a time division electrokinetic sorter system. An exemplary pattern of channels on a microfluidic chip in such a sorter system is shown in FIG. 2. The pattern of channels shown in FIG. 2 includes a detection region 106 which can have similar characteristics as the previously described detection regions in FIGS. 1(*a*) and 1(*b*). In FIG. 2, a first inlet channel 102 and a second inlet channel 104 can respectively feed liquid media including targets and analytes to the detection region 106. For example, the first inlet channel 102 may introduce a sample which may contain an analyte of interest to the detection region 106. The second inlet channel 104 can be used to introduce charged targets to the detection region 106. The introduction of targets and analytes to the detection region 106 may take place substantially simultaneously or sequentially.

A first outlet channel 108 and a second outlet channel 110 may be used allow liquid media, targets, analytes, or bound target-analyte pairs to pass downstream of the detection region 106. For example, the first outlet channel 108 can be used to drain bound analytes of interest from the system. The second outlet channel 110 can be used as a waste drain.

The paths taken by entities passing from the detection region 106 can be controlled by applying an electrostatic field in the detection region 106 so that the sorter system can be used to "sort" entities that pass downstream of the detection region 106. Put another way, the detection region 106 can be biased or not biased (as described above) and entities such as bioentities can be trapped or not trapped. In this way, the movement of the bioentities through the system can be controlled.

Any suitable mechanism can be used to control the direction of the flow of entities downstream of the detection region 106. For example, to direct the flow of positively charged targets to the first outlet channel 108, point "Y" can have an electrode (not shown) which is electrically biased to repel the charged targets and anything that is bound to the charged targets, thus preventing them from entering the second outlet channel 110. The charged targets will thus pass to the first outlet channel 108.

In another illustration, as shown in FIG. 2, the first and second inlet channels 102, 104 can be used for injecting negatively charged antibodies and a blood sample which may contain the bioentities of interest, respectively. The first and second inlet channels 102, 104 merge into a wider middle detection region 106 where any potential binding of the bioentities to the antibodies can take place. Clumps of antibodies and bioentities will be produced at the detection region 106 and these clumps will be positively charged, because of the positively charged antibodies in the clumps. They can be localized at the negatively charged detection region 106. As described previously, scattered light can be detected and information about the presence and/or quantity of bioentity analytes in the liquid sample may be determined.

The clumps of charged antibodies and bioentity analytes can be sorted by controlling the applied electrostatic field in the evanescent detection region 106 and the voltages at the ends of the two outlet channels 106, 110 at appropriate times, since the voltages dictate the direction of the fluid flow. When the bioentities remain trapped by electrostatic force in the detection region 106, it is possible to direct the fluid into the second outlet channel 110 (e.g., the waste drain). If significant aggregation is detected at the detection region 106 by the optical detector, the detection region electrostatic field can be turned off to release the clumps which are then directed into the first outlet channel 108 (e.g., the bioentities drain).

Another suitable design is a time division sorter with microvalves and micropumps. This design is similar to the previously described design, but differs in that it incorporates microvalves and micropumps to control fluid flow (Fu, A. Y. et al., *Analytical Chemistry* 74(11):2451-2457 (2002)), which replace the electrokinetic mechanism in the previously described sorter.

Figure 3:
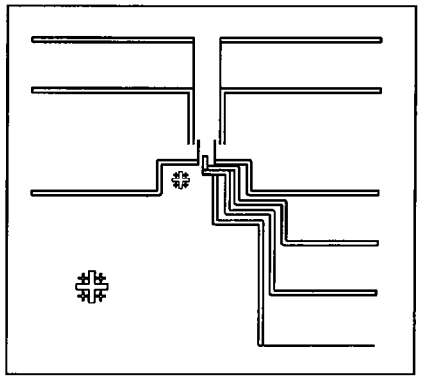
FIG. 3 shows a schematic plan view of a control layer in a microfluidic system.
Figure 4:
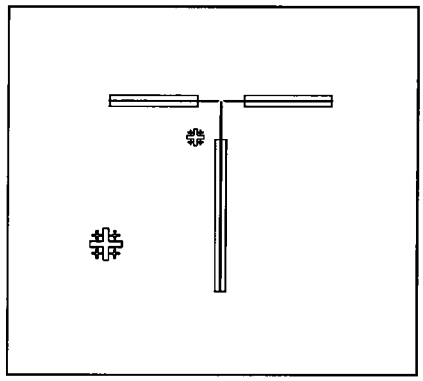
FIG. 4 shows a schematic plan view of a fluidic layer in a microfluidic system.

As described in Fu, A. Y. et al., *Analytical Chemistry* 74(11):2451-2457 (2002), an integrated sorter system with microvalves and micropumps can be made of two different layers of elastomeric channels bonded together using multilayer soft lithography. The top layer has the control line where the valves will be pneumatically actuated (see FIG. 3). The top layer may comprise a flexible material such as parylene. The bottom layer consists of the fluidic line where the sample will be introduced and interrogated (see FIG. 4). Referring to FIG. 2, a microfluidic valve (known in the art) can be present at point "Y" so that the passage of fluid to the second outlet channel 110 can be controlled.

Figure 5:
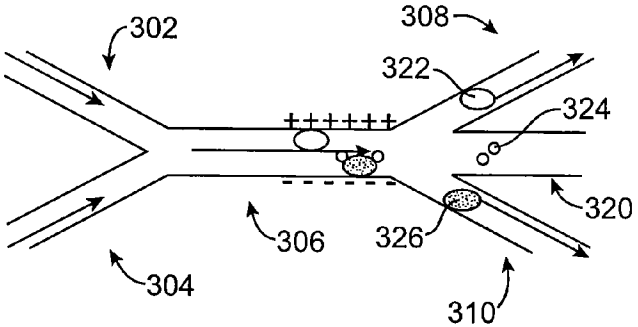
FIG. 5 shows another schematic view of another system including a sorter.

Yet another sorter system can be a charge division sorter. This is shown in FIG. 5. In this scheme, the channel pattern is similar to the design in FIG. 2, but the particles in the liquid media can be sorted according to the polarity of their electrical charges. Specifically, FIG. 5 shows first and second inlet channels 302, 304 that lead to a detection region 306, and first, second, and third outlet channels 308, 310, and 312 which lead downstream of the detection region 306. The first inlet channel 302 can be used to introduce a liquid sample with a bioentity of interest. The second inlet channel 304 can be used to introduce positively charged target antibodies to the detection region 306. The first outlet channel 308 may be a negatively charged waste drain, the second outlet channel 310 may be a neutral waste drain, and the third outlet channel 312 may be a positively charged waste drain. Negatively charged entities 322 may pass down the first outlet channel 308. Neutral entities 324 may pass down the second outlet channel 310. Positively charged entities 326 may pass down the third outlet channel 312. Appropriate electrical biasing elements may be used to bias the channels as described above.

III. PHOTONIC CRYSTAL FIBER EVANESCENT WAVE DETECTION SYSTEMS

Some detection systems may use photonic crystal fibers (PCFs) instead of the planar waveguides that are specifically described above. Photonic crystal fibers are characterized by a pattern of longitudinal air holes running along the entire length of the fiber. A radial cross-section of a typical photonic crystal fiber will show an array of longitudinal holes. When the right fiber is selected, a large fraction of the optical field can propagate through the fiber as an evanescent field and will penetrate into liquid samples within the fiber's air holes. When using conventional fibers as waveguides, a portion of the cladding needs to be removed in order to obtain an overlap between the optical field and the sample to be analyzed. However, the air holes in a photonic crystal fiber provide access for the liquid samples to regions with strong optical fields. Photonic crystal fiber-based evanescent-wave sensors such as these can retain their claddings and coatings, thereby ensuring robust devices. Photonic crystal fibers are described in Jensen, J. B. et al., *Optics Letters* 29(17):1974-1976 (2004), which is herein incorporated by reference in its entirety.

Figure 6:
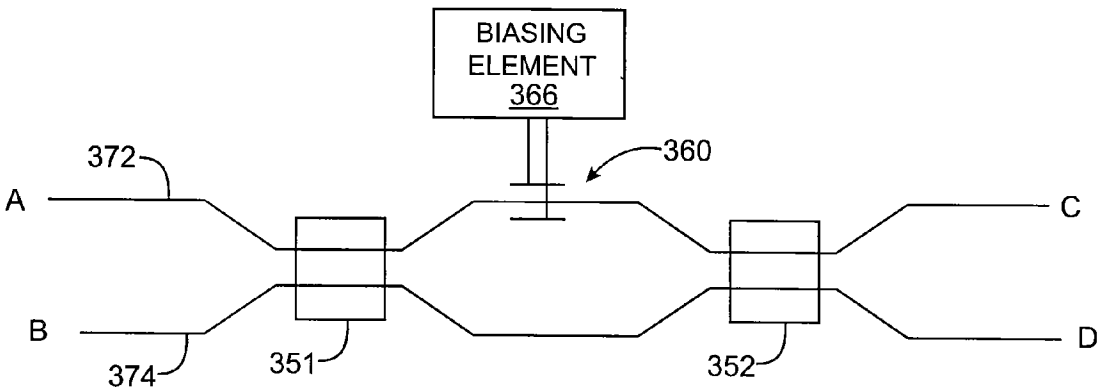
FIGS. 6-7 show schematic views of other systems according to embodiments of the invention. Unlike the previous embodiments, an optical fiber or cable is employed instead of a planar waveguide in FIGS. 6-7.

In order to couple light into a photonic crystal fiber while flowing solution through the air holes in the photonic crystal fiber, the photonic crystal fiber can be combined with a conventional optical fiber coupler. This coupler can be fabricated by coupling a photonic crystal fiber with a convention optical fiber at two locations as indicated in FIG. 6. FIG. 6 shows a system including a photonic crystal fiber 372 and a conventional optical fiber 374. They are coupled together at a first location using a first 2×2 optical coupler 351 and at a second location using a second 2×2 optical coupler 352. As shown in FIG. 6, a biasing element 366 may apply a bias (e.g., a DC or AC bias) to portions of the photonic crystal fiber 372 at a detection region 360. For example, as described above, a portion of the photonic crystal fiber 372 may coated with a conductive material or may be rendered electrically conductive (e.g., by doping). As in other embodiments, a portion of the photonic crystal fiber 372 may be electrically biased so that charged analytes are localized at the detection region 360.

Illustratively, with the device shown in FIG. 6, a sample solution flows into one end A of the photonic crystal fiber 372 and in the air holes (not shown) until it comes out of the other end at terminal C. Light is coupled into the photonic crystal fiber 372 by the first 2×2 coupler 351. By detecting the interference signal at the output of the second coupler 352 (terminal D), it is possible to acquire information about the intensity and phase shift of the light that travels in the photonic crystal fiber 360, whose modes should be to some extent disturbed due to the scattering of the evanescent field by scatterers in the solution that flows in the air holes. It is also possible to measure the back-scattered light caused by scatterers at terminal B, which also provides information about the quantity and size of the scatterers in the air holes. Thus, appropriate optical detectors (not shown) may be at terminals B and D.

As described above, a photonic crystal fiber (PCF) can serve as an optical waveguide while channeling fluids in holes. In some embodiments, the evanescent fields in the photonic crystal fiber can penetrate some distance (e.g., 1 micron) into the holes of the fiber. The holes may have diameters of about 6 microns in some embodiments.

In other embodiments, it is possible to taper the mid-section of a photonic crystal fiber down to about 1 to about 2 microns and then apply an AC voltage between the mid-section and the ends of the fiber. A tapered photonic crystal fiber can be formed by pulling the ends of a fiber when it is heated. When the targets and analytes move from the ends to the mid-section of the fiber, more evanescent waves in the holes will be scattered. This is because the entities in the holes of the photonic crystal fiber have a higher probability of scattering the evanescent waves in the smaller diameter hole sections in the mid-section of the photonic crystal fiber than in larger diameter hole sections at the ends of the photonic crystal fiber. The detected scattered evanescent waves can be a function of the length of the photonic crystal fiber (the distance that the entitles have to travel when the bias polarity reverses), the hole size, the viscosity of the fluid, and the entity size and mass-to-charge ratio. Similarly to the transverse modulation case above, it is possible to determine the presence and properties of the paired bioentities by measuring the scattered evanescent waves.

Figure 7:
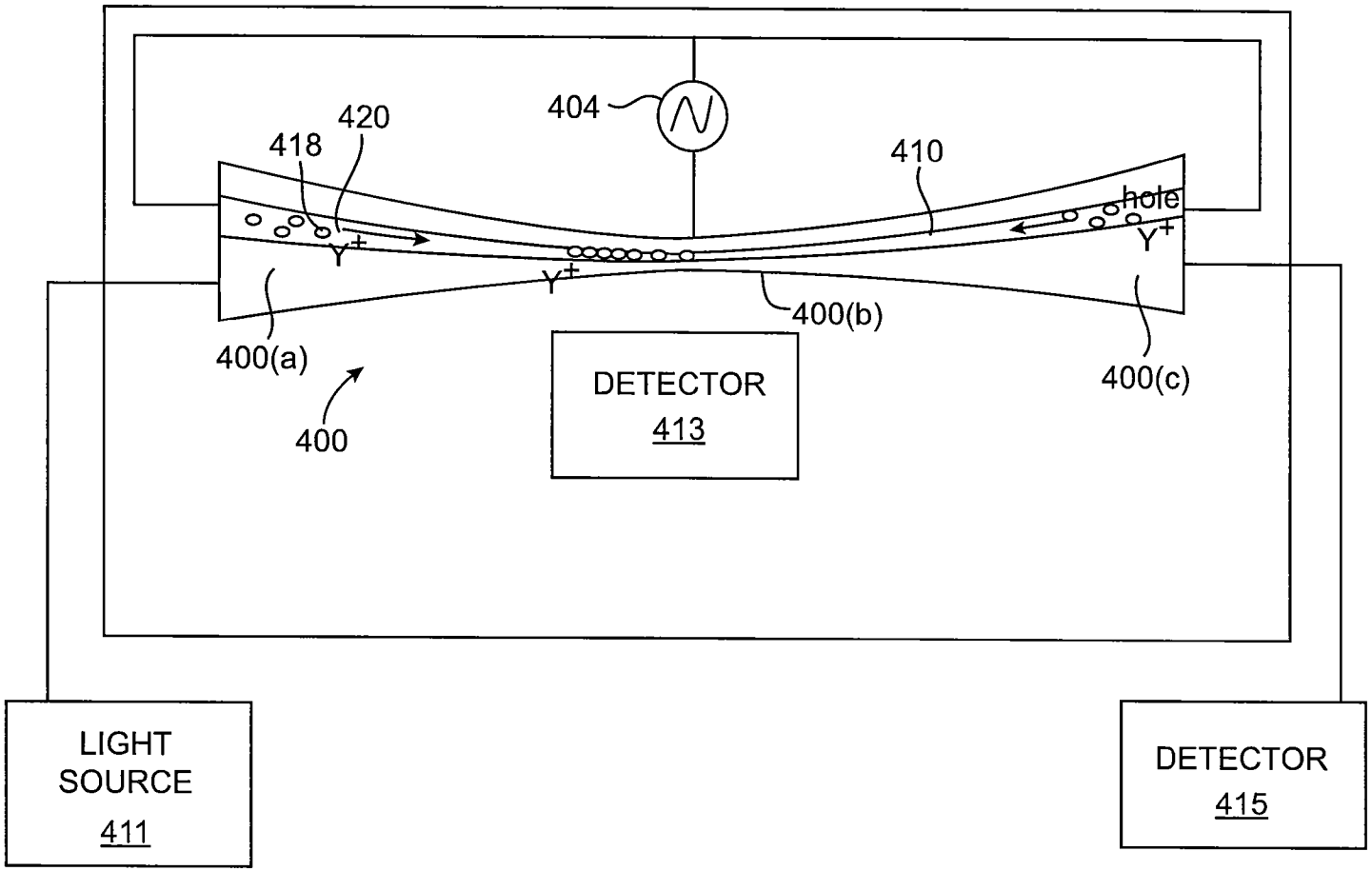

As shown in FIG. 7, a tapered photonic crystal fiber 400 serves as a waveguide and a fluidic channel. A longitudinal hole 410 runs along the length of the photonic crystal fiber 400. (One hole 410 is shown for simplicity of illustration. It is understood that other embodiments of the invention may include an array of longitudinal holes.) An AC biasing element 404 applies an AC-bias between the mid-section 400(*b*) and the ends 400(*a*), 400(*c*) of the photonic crystal fiber 400. A light source 411 provides light to the photonic crystal fiber 400 and a detector 413 may detect evanescent wave signal changes from the mid-section of the photonic crystal fiber 400. When in the mid-section 400(*a*), charged target 420 and analyte 418 pairs scatter more evanescent waves. Alternatively or additionally, a second detector 415 may be used to detect changes in the light that propagates through the photonic crystal fiber 400.

IV. ADVANTAGES OF EMBODIMENTS OF THE INVENTION

Embodiments of the invention provide many advantages. The recitation of such advantages does not limit the scope of the inventions claimed.

First, in embodiments of the invention, the targets of interest can be easily modified. For example, unlike the antibody based virus detection systems that are presently in use, embodiments of the invention minimize the need to functionalize antibodies (e.g., with fluorescent tags of the like). It is easier to charge an antibody than to fluorescently tag it or attach it to an enzyme.

Second, embodiments of the invention are flexible and reusable. For example, the systems according to embodiments of the invention can be used for different assays by simply changing the antibody types being used. The proposed system may also be flushed and reused. Alternatively, embodiments of the invention can be inexpensively produced and may be disposable.

Third, embodiments of the invention can be used for high throughput screening. Embodiments of the invention can use small volumes and can electrostatically sort entities. This suggests that assays can be performed at high throughput rates using embodiments of the invention.

Fourth, it is possible to isolate and concentrate specific bioentities (or other analytes or targets) of interest. For example, the above-described systems can be used for concentrating specific bioentities. By continuously flowing a plasma and antibody mix across the charged waveguide portion, it is possible to accumulate bio-entities on the waveguide. The bioentities can be subsequently released and collected by simply reversing the polarity of the waveguide. This can be useful in situations where it is desirable to isolate a detected virus species for subsequent analysis.

Fifth, embodiments of the invention can be used for bioentity (e.g., antibody) sorting. The specific nature of the antibody binding suggests that it is possible to detect a specific class of white blood cells, perform platelet counting, and perform a range of other agent specific detection processes.

Any of the above noted embodiments may be automated. Appropriate computer software to control the above-described systems can be created by those of ordinary skill in the art. Such computer software may be written in any suitable computer language including C, C++, etc. Also, in the systems according to embodiments of the invention, computers may also be coupled to the detectors to perform automated data analysis.

The above description is illustrative but not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

One or more features of any embodiment of the invention may be combined with one or more features of any other embodiment of the invention without departing from the scope of the invention.

As used herein, any recitation of "a", "an" or "the" is intended to mean "one or more" unless specifically indicated to the contrary.

All patents, patent applications, publications, and descriptions mentioned above are herein incorporated by reference in their entirety for all purposes. None is admitted to be prior art.

What is claimed is:

1. A system comprising:

a fluid channel;

a waveguide associated with the fluid channel;

a detection region associated with the waveguide;

a biasing element operatively coupled to the detection region, wherein the biasing element is adapted to electrically bias a portion of the waveguide at the detection region; and an optical detector adapted to detect optical changes from the detection region, wherein the waveguide forms at least one side of the fluid channel, and wherein the fluid channel is a microfluidic fluid channel having a channel dimension of less than about 1 micron.

2. The system of claim 1 wherein the biasing element is a DC or AC voltage source.

3. The system of claim 1 wherein the waveguide is a flat waveguide.

4. A system comprising:

a fluid channel;

a waveguide associated with the fluid channel;

a detection region associated with the waveguide;

a biasing element operatively coupled to the detection region, wherein the biasing element is adapted to electrically bias a portion of the waveguide at the detection region; and an optical detector adapted to detect optical changes from the detection region, and further comprising a wall forming a side of the fluid channel, wherein the wall is also coupled to the biasing element and the biasing element is adapted to bias the wall.

5. A system comprising:

a fluid channel;

a waveguide associated with the fluid channel;

a detection region associated with the waveguide;

a biasing element operatively coupled to the detection region, wherein the biasing element is adapted to electrically bias a portion of the waveguide at the detection region; and an optical detector adapted to detect optical changes from the detection region, and wherein the optical detector detects scattered evanescent waves.

6. A system comprising:

a fluid channel;

a waveguide associated with the fluid channel;

a detection region associated with the waveguide;

a biasing element operatively coupled to the detection region, wherein the biasing element is adapted to electrically bias a portion of the waveguide at the detection region; and an optical detector adapted to detect optical changes from the detection region, and wherein the fluid channel and the waveguide are present in a photonic crystal fiber.

7. A method comprising:

electrically biasing a portion of a waveguide at a detection region, wherein the waveguide is associated with a fluid channel;

localizing charged targets at the detection region;

supplying a fluid to the detection region wherein the fluid comprises analytes; and detecting whether or not analytes interact with the localized targets.

8. The method of claim 7 wherein biasing comprises applying an AC or DC bias to the portion of the waveguide.

9. The method of claim 7 wherein the fluid channel and the waveguide are present in a photonic crystal fiber.

10. The method of claim 7 wherein the fluid channel is a microfluidic fluid channel.

11. The method of claim 7 wherein the charged targets are in the fluid.

12. The method of claim 7 wherein the fluid is a liquid.

13. The method of claim 7 wherein the targets and analytes are biological entities.

14. The method of claim 7 wherein the waveguide is a flat waveguide, and wherein the flat waveguide comprises silicon.

15. The method of claim 7 wherein scattered evanescent waves are detected from the detection region.

16. The method of claim 7 wherein the waveguide forms at least one side of the fluid channel.

17. The method of claim 7 wherein the charged targets are charged antibodies.

18. The method of claim 7 wherein the fluid channel is present in an optically transmissive fiber or cable.

* * * * *